US008002490B2

(12) United States Patent
Hamlen

(10) Patent No.: US 8,002,490 B2
(45) Date of Patent: Aug. 23, 2011

(54) CORNER PIECE FOR VALANCE INTERFACE IN CASES AND CONTAINERS

(75) Inventor: James Gregory Hamlen, Thornhill (CA)

(73) Assignee: Impact Cases Inc., Markham, Ontario (CA)

( * ) Notice: Subject to any disclaimer, the term of this patent is extended or adjusted under 35 U.S.C. 154(b) by 110 days.

(21) Appl. No.: 11/947,537

(22) Filed: Nov. 29, 2007

(65) Prior Publication Data

US 2008/0131197 A1 Jun. 5, 2008

Related U.S. Application Data

(60) Provisional application No. 60/867,643, filed on Nov. 29, 2006.

(30) Foreign Application Priority Data

Nov. 28, 2006 (CA) ..... 2569136

(51) Int. Cl.
*B65D 6/00* (2006.01)

(52) U.S. Cl. ..... 403/174; 403/178; 206/509; 220/4.27

(58) Field of Classification Search ..... 403/174, 403/178, 205, 382, 403; 312/108, 111, 140, 312/257.1; 206/503, 509; 220/4.26, 4.27, 220/4.28, 4.33

See application file for complete search history.

(56) References Cited

U.S. PATENT DOCUMENTS 2,980,285 A 4/1961 Parsons
3,044,656 A 7/1962 Combs et al.
3,272,582 A 9/1966 Anderson et al.
3,517,849 A * 6/1970 Presnick ..... 220/4.28
3,561,633 A 2/1971 Morrison et al.
3,784,043 A 1/1974 Presnick
3,815,966 A 6/1974 Lyman, Jr.
3,885,701 A 5/1975 Becklin
3,955,702 A * 5/1976 Lundy ..... 220/4.28
3,989,157 A 11/1976 Veenema (Continued)

FOREIGN PATENT DOCUMENTS

CA 103125 S 3/2004

(Continued)

*Primary Examiner* — Michael P Ferguson
(74) *Attorney, Agent, or Firm* — Sheema Khan; Miltons IP/p.i.

(57) ABSTRACT

A unitary, bent corner piece for a valance frame has an extending tongue at each end shaped to interfit the hollow cross-section of an adjacent, extruded, valance frame member. Complementary corner pieces so formed provide part of a valance interface between the lid and body of a container, ensuring sealing continuity around corners fitted with such corner pieces. Each corner piece is provided with a mating valance surface for presentation to the valance interface to provide an intimate engagement with the mating valance surface of the complementary, opposed corner piece. Gaskets fitted within the corner pieces may form part of the interface. Tongues formed a at the respective ends of a corner piece are provided with a groove to accommodate the inclusion of a gasket into the interior core of the longitudinal frame members. Corner pieces may also be formed with two or more cavities beneath the valance surface, such cavities being defined by bridging walls extending from an inside surface of the corner piece to an outside surface of the corner piece. The outside surface of a corner piece may be provided with one or more perforated fastener openings, penetrating the outside wall of the corner piece, for attaching sidewalls of a container to the corner piece.

17 Claims, 9 Drawing Sheets

U.S. PATENT DOCUMENTS

| | | | | |
|---|---|---|---|---|
| 4,002,261 | A | 1/1977 | Litchfield | |
| 4,045,104 | A | 8/1977 | Peterson | |
| 4,095,719 | A | 6/1978 | Wolf | |
| 4,422,558 | A | 12/1983 | Mittelmann et al. | |
| 4,593,831 | A | 6/1986 | Clive-Smith | |
| 4,691,970 | A | 9/1987 | Neri | |
| D303,457 | S | 9/1989 | Stewart | |
| 4,905,857 | A | 3/1990 | Her | |
| 4,993,585 | A | 2/1991 | McMahon | |
| D317,400 | S | 6/1991 | Loew | |
| 5,020,866 | A | 6/1991 | McIlwraith | |
| 5,036,979 | A | 8/1991 | Selz | |
| 5,037,027 | A | 8/1991 | Nichols | |
| 5,066,161 | A | 11/1991 | Pinney | |
| 5,655,662 | A | 8/1997 | Garcia | |
| 5,820,289 | A | 10/1998 | Kern et al. | |
| 5,947,037 | A * | 9/1999 | Hornberger et al. | 108/115 |
| 5,983,420 | A | 11/1999 | Tilley | |
| 6,205,738 | B1 | 3/2001 | Chen | |
| 6,223,917 | B1 | 5/2001 | Bruder | |
| D454,692 | S | 3/2002 | Bublitz | |
| D455,266 | S | 4/2002 | Bradford | |
| D460,263 | S | 7/2002 | Bradford | |
| 6,547,127 | B2 * | 4/2003 | Bradford et al. | 220/4.28 |
| 6,561,603 | B2 | 5/2003 | Knab et al. | |
| 6,564,521 | B1 | 5/2003 | Brown et al. | |
| 6,929,125 | B1 | 8/2005 | Seamans | |
| 7,056,270 | B2 | 6/2006 | Mellott et al. | |

FOREIGN PATENT DOCUMENTS

| | | | |
|---|---|---|---|
| CA | 106375 | S | 10/2005 |
| GB | 2094878 | A | 9/1983 |
| WO | WO-03070499 | A1 | 8/2003 |

* cited by examiner

CORNER PIECE FOR VALANCE INTERFACE IN CASES AND CONTAINERS

This application claims the benefit of U.S. Provisional Patent Application No. 60/867,643 with a filing date of Nov. 29, 2006.

FIELD OF THE INVENTION

This invention relates to sealable cases and containers. More particularly, it relates to a corner piece along the closure or valance interface of a case or container having a lid. The invention also applies wherever two objects mate along a valance interface.

BACKGROUND TO THE INVENTION

Valuable and/or fragile objects often require storage or transportation in protective cases or containers. Typically, cases or containers which accommodate these objects are designed to be sturdy and strong. Although many different styles of containers exist, three primary designs are as follows, wherein the description is with respect to the figures described further below.

The first case style makes use a single base 1 and a single lid 2 is shown in FIG. 1A. An interior frame system (not shown) is typically located along the closure interface 10, or valance 10, between the lid 2 and base 1 of the case/container. This interior frame system is used to support the container's structural integrity, as well as generate and maintain alignment between the lid 2 and base 1. It must also resist lateral shearing forces at the lid—base interface, prevent dust and dirt from entering the closed case, and, when required, act as an impermeable seal. The lid may be hinged at 9 as shown in FIG. 1B.

The second case style, as shown in FIGS. 2A, 2B, comprises multiple base shells 4 each having an open top and bottom and two lids 2 which respectively enclose the ends of the assembled shells 4. The base shell 4 and lids 2 have similar lateral profiles; however, the depth of the base shells 4 and each lid 2 may differ. An interior frame system (not shown) is located along the closure interface 10, or valance 10, between each base shell 4 and at each lid 2 of the case. This interior frame system functions as in the first case, described above.

In order for containers, such as those described above, to maintain their shape and structural integrity, it is highly desirable that, at the valance 10 (e.g. at a lid-base or base shell-base shell boundary), the rigidity and alignment of the sub-frames carrying mating valance surfaces at the valance interface 10 be properly maintained. Any lateral movement produced at these boundaries will compromise the integrity of the container and potentially endanger the contents within.

Rectangular cases and containers use frame systems to increase rigidity at the valance and prevent unwarranted lateral movement between lid—base and base—base boundaries. The valance frame system typically consists of two continuous, complementary frame subassemblies 5 and 6, disposed around the perimeter of the opposing open faces of each adjacent container segment, cf. FIG. 3. These valance frame subassemblies must circumscribe the profile of the case in order to provide a complete seal.

In order for correct alignment to be attained and maintained at a valance interface, each corresponding pair of frame subassemblies should preferably have complementary profiles. That is to say, the valance interface of each pair of frame subassemblies must mate, preferably intimately.

Common complementary subassembly interface profiles may include the following styles:

Tongue and Groove:

(FIG. 4A) A. a male subassembly possessing a single protruding ridge profile and a female subassembly possessing a complementary, recessed groove profile.

(FIG. 4B) B. a male subassembly possessing a plurality of protruding ridge profiles and a female subassembly possessing a plurality of complementary recessed groove profiles.

Hybrid:

(FIG. 5A) A. a male and female subassembly, each possessing complementary interface profiles, consisting of a single protruding ridge and a single recessed groove.

(FIG. 5B) B. male and female subassembly, each possessing complementary profiles, consisting of a plurality of protruding ridge and a plurality of recessed grooves.

Rectangular cases and containers typically use metallic valance frame systems. The most common choice of metal is aluminum, as complex profiles can be readily extruded from this material in continuous lengths. Plastics may also be used as they are also readily extruded into complex profiles of continuous lengths.

The existing valance frame system used in conjunction with continuous valance frames in a container having tight radius corners often lacks substantial flexural strength and lateral shear resistance because the cross-sectional profile of such frames must be thin and simple enough to facilitate bending of the valance frame sub-section around the radius of the corner. The gap or a butt joint formed between the two ends of the bent frame member is also a point of flexural weakness (see item 17 in FIG. 3). Further, eliminating or minimizing the gap distance is difficult to achieve on a consistent, repeatable basis.

When constructing frame assemblies for various uses, it is known in the art to replace a corner of the frame with a unitary corner piece. For example, U.S. Pat. No. 4,045,104 describes "[a] cabinet structure [having] a plurality of tubular frame members having holes in the interior side walls thereof near the ends of the members, and a plurality or corner members for joining the frame members together . . . The corner members are fitted in the frame members by pivoting the legs thereof into the ends of the frame members so that the nipples are received into corresponding holes in the side walls of the frame members."

U.S. Pat. No. 4,095,719 describes a typical sort of casing hardware in which the valance interface consists of a male and female joining edge, the female joining edge being provided with a rubber gasket to yield a stronger seal. There is no teaching, however, of a corner piece in this patent.

U.S. Pat. Nos. 4,691,970 and 3,815,966 both describe cabinets that use similar corner piece frame structure. Both describe cabinets in which all panel members are joined to an intermediary frame structure.

U.S. Pat. No. 3,784,043 describes a framing rail system for a collapsible structure. However, its corners are hermaphroditic such as those used in geodesic domes. As such the invention cannot be used for a container-type object that requires a means of opening and closing the container easily in order to seal the volume inside the container.

There exist many different references which make use of similar corner pieces in completing a frame assembly, including:

U.S. Pat. No. 5,820,289 patented Oct. 13, 1998 by Schroff GmbH

U.S. Pat. No. 3,272,582 patented Sep. 13, 1966 by E. V. Anderson et al

U.S. Pat. No. 5,066,161 patented Nov. 19, 1991 by R. C. Pinney

U.S. Pat. No. 6,561,603 patented May 13, 2003 by Knuerr-Mechanik fuer die Electronik Aktiengesellschaft U.S. Pat. No. 5,020,866 patented Jun. 4, 1991 by Gichner Systems Group, Inc.

U.S. Pat. No. 6,223,917 patented May 1, 2001 by Octanorm-Vertriebs-GmbH fuer Bauelemente U.S. Pat. No. 5,983,420 patented Nov. 16, 1999 by M. L. Tilley The above references described frames for containers without focusing on the presence of a valance interface.

Oftentimes, due to the nature of the cargo, it is essential for the container or receptacle used for the transportation or storage of an object or objects to be substantially airtight and/or watertight. The following references offer examples of airtight or watertight containers:

U.S. Pat. No. 3,885,701 patented May 27, 1975 by Environment Container Systems, Inc.

U.S. Pat. No. 6,929,125 patented Aug. 16, 2005 by Foam Technologies, Inc.

U.S. Pat. No. 4,905,857 patented Mar. 6, 1990 by L. M. Her et al

For the most part, these patents address frame systems which run along three axes to provide a complete mechanical frame onto which sidewalls may be installed. Corner pieces in such systems extend outward on three axes (X, Y, and Z) so they may connect with three independent longitudinal frame members. The present invention preferably addresses a 2-axis or planar frame arrangement which serves to provide the base-base and lid-base valances subassemblies.

It would therefore be advantageous to provide corner pieces for a valance interface that are distinguished from the prior art by being simple in construction while having substantial strength and rigidity, and being resistant to lateral shearing forces and misalignment. Such a valance interface is suitable for use around the closing edges of lidded containers but also has applications in any situation where a valance interface is formed, e.g. around the perimeter of a doorframe.

The invention in its general form will first be described, and then its implementation in terms of specific embodiments will be detailed with reference to the drawings following hereafter. These embodiments are intended to demonstrate the principle of the invention, and the manner of its implementation. The invention in its broadest and more specific forms will then be further described, and defined, in each of the individual claims which conclude this Specification.

SUMMARY OF THE INVENTION

According to one aspect of the invention, a bent corner piece for a valance frame has a shaped valance interface surface that extends continually around the face of the bend and an extending tongue at each of the two ends of the corner piece, each tongue being shaped to interfit and engage, preferably intimately, with a recess formed in the end of an adjacent, preferably extruded, longitudinal frame member carrying an aligned valance along one side. Complementary corner pieces so formed can provide part of a valance interface between the lid and body of a container as examples of two objects being mated, ensuring sealing continuity around corners fitted with such corner pieces as well as along the longitudinal frame members.

Each corner piece is provided with a mating valance surface for presentation to the valance interface to provide an intimate engagement with the mating valance surface of the complementary, opposed corner piece. According to one preferred variant, the corner piece is unitary as may result from casting of the corner piece. The corner piece is bent in the sense that it changes direction along its length. Each corner piece may be bent at 90°, or at some other angles as, for example at two 45° angles that collectively complete the corner to provide a chamfered corner.

Gaskets extending continuously from the interconnected longitudinal frame members may be fitted within one or more of the corner pieces to form part of the valance interface. The gaskets, optionally in the form of rubber strips, are preferably seated in the base of a groove formed in a female recess within the corner piece and adjacent longitudinal frame members. Dual gaskets may be fitted into the respective grooves of complementary corner pieces and longitudinal frame members that respectively have grooves as well as ridges which extend into the groove of the opposite corner piece and longitudinal frame members for engagement with such gaskets.

The corner pieces are provided with face surfaces extending away from the valance interface for fastening against the sidewalls of a container. Corner pieces may be formed with two or more cavities beneath the valance surface, such cavities being defined by bridging walls extending from an inside wall of the corner piece to an outside wall of the corner piece, each wall respectively providing an inside and outside face surface for the corner piece, one of which surfaces may lie against a container sidewall. The outside surface of a corner piece may be provided with one or more perforated fastener openings, penetrating the outside wall of the corner piece, for attaching sidewalls of a container to the corner piece.

A corner piece of the invention is intended to form part of a valance frame assembly which in turn, provides the valance interface between two objects being mated. The valance frame assembly generally comprises two valance frame subassemblies, respectively carried on each of the two objects being mated. Each valance frame subassembly will typically include a plurality of longitudinal frame members carrying a valance interface surface along one edge and joined together at their respective ends by corner pieces with valance surfaces that are aligned with the valance surfaces of the longitudinal frame members. The longitudinal frame members preferably are extruded and have ends with recesses formed therein to facilitate coupling with the corner pieces through reception of protruding tongues extending from the respective ends of each corner piece. Each corner piece comprises:

a) an extending tongue at each end of such corner piece, each tongue being shaped to engage, preferably intimately, with a recess formed in the end of an adjacent longitudinal frame member when fitted to the corner piece; and b) a mating valance surface disposed along a valance interface on the corner piece for an aligned engagement with a valance surface of a complementary corner piece to be fitted to an opposite valance frame subassembly.

A corner piece may have a groove along its shaped mating valance surface which engages with a ridge on a complementary corner piece, and vice versa. Alternately, the mating valance surface of the corner piece may have both a groove and a ridge formed therein with the complementary corner piece similarly having a groove and ridge of complementary shape and location. When such complementary corner pieces inter-fit, the valance interface is formed. In this way, a pair of corner pieces each will have mating valance surfaces each of a shape that will provide an intimate engagement with the mating valance surface of the other corner piece, the ridge(s) of one corner piece engaging the groove(s) on the other corner piece and vice versa.

This interface may comprise one or more grooves and/or one or more ridges which substantially extend along the length of the corner piece and arc aligned with the corresponding grooves and ridges of adjacent longitudinal frame members. In a preferred embodiment, the interface is provided with one ridge and one groove shaped so that two corner pieces having the same profiles will inter-fit with each other in a scaling engagement. However, any combination of ridges and/or grooves may be employed at the valance interface.

Whether a groove is formed in only one or both members of a complementary corner piece there, such groove may include a continuous gasket recess, the continuous recess being shaped so as to accept and retain a gasket with a close embracing fit. With a gasket in place within the gasket recess, a ridge of a complementary corner piece is positioned and dimensioned to engage with the seated gasket to provide a seal between the two corner pieces. Preferably, the recess formed within a groove is positioned at the base of such groove. Where each of a pair of complementary corner pieces is respectively provided with grooves, each may be provided with a gasket recess for gaskets to be fitted therein.

The groove of a corner piece is intended to be aligned with the groove formed in an adjacent longitudinal frame member. The recess in the end or core of such adjacent frame member, particularly if the frame member is fabricated by extrusion, may be shaped to provide room for the groove to be present in the frame member. A deep groove in the frame member may intrude into the hollow core of the longitudinal frame members, reducing the shape and size of the recess at its ends. In such case the tongue at each end of the corner piece may be shaped with a cross-sectional shape other than in the form of a rectangle. Such tongues may be provided with a tongue groove formed along the lengths of such tongue to engage with a frame member recess that is shaped to accommodate the presence of a frame member groove.

A corner piece preferably is formed with a plurality of cavities underlying the valance surface of the corner piece wherein such cavities are defined by a one or more bridging walls extending from an insidewall of the corner piece to an outside wall of the corner piece. Each cavity may then be provided with one or more perforated fastener openings penetrating the outside wall of the corner piece for attaching sidewalls of a container to the corner piece. These perforated fastener openings provide for a robust attachment of the external sidewall of the container to the corner pieces. Such a firm attachment is highly desirable in order to maintain the alignment of the corner pieces.

A plurality of corner pieces made in accordance with this invention may be used in a container having a lid and body that inter-fit along a valance interface. Two valance frame subassemblies each carrying complementary mating valance surfaces may be respectively provided on the lid and body to define the valance interface. Each valance frame subassembly can be constructed from a plurality of longitudinal frame members at the respective ends of which a corner piece is fitted. The longitudinal frame members are preferably formed with ends having recesses formed therein to receive the tongues of each corner piece.

Side panels forming walls for the container may then overlie the longitudinal frame members as well as the corner pieces, being fastened to these components. Fasteners may extend through such sidewall panels and the perforated fastener openings in the corner pieces for attaching sidewalls of a container to the corner pieces. In order to form a highly rigid container it is most preferable that the side panels be fixed to the longitudinal frame members, preferably along their entire length. These components can be attached to each other through use of screws, rivets, or, preferably, through appropriate adhesives, welding or brazing. Such attachment is highly desirable in order to maintain the alignment of the longitudinal frame members and corner pieces.

In addition to a valance frame subassembly's complementary ridge and groove arrangement, each subassembly should preferably possess a supplementary, shoulder profile which comes into contact with the adjacent edge of a container side wall panel. This assists in ensuring that the valance frame subassembly is fixed in a consistent position along the edge of the wall panel of the base or lid segment of the case to which it is attached. This shoulder profile may be in the shape of a protruding rectangular shoulder formed on the longitudinal frame members and on the corner pieces. This profile on each corner piece functions by overlying the attached edge of the adjacent sidewall panel in order to improve the alignment of the subassembly.

Where the longitudinal frame members are extruded, it is convenient to form such a shoulder profile on both sides of the longitudinal frame member. This saves having two different extrusion dies. When the longitudinal frame members have a shoulder profile on both sides, it is desirable for the corner pieces to have a shoulder profile on both sides. Thus an interior shoulder profile on the corner piece may be present in order to line-up with an interior shoulder profile on the adjacent longitudinal frame member.

The foregoing summarizes the principal features of the invention and some of its optional aspects. The invention may be further understood by the description of the preferred embodiments, in conjunction with the drawings, which now follow.

BRIEF DESCRIPTION OF THE DRAWINGS

FIGS. 5A and 8B are respectively pictorial and side views of assembled corner pieces having a beveled face at the corner.

DESCRIPTION OF THE PREFERRED EMBODIMENT

Figure 1A:
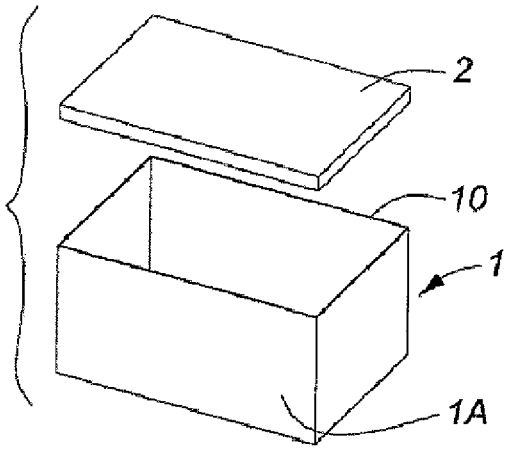
PRIOR ART FIG. 1A
FIGS. 1A and 1B are pictorial depictions of a prior art open box with a lid having a valance interface, respectively with a free lid and a hinged lid.
Figure 1B:
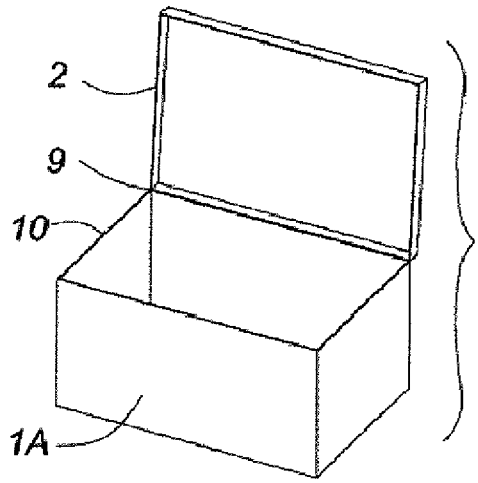
PRIOR ART FIG. 1B
Figure 2A:
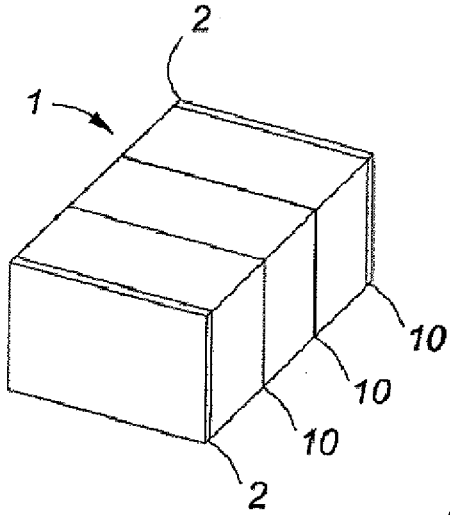
FIG. 2A PRIOR ART
FIGS. 2A and 2B are pictorial depictions of a prior art container with multiple shells having multiple valance interfaces, the container being bounded at its ends by dual lids having valance interfaces, respectively assembled and in exploded view.
Figure 2B:
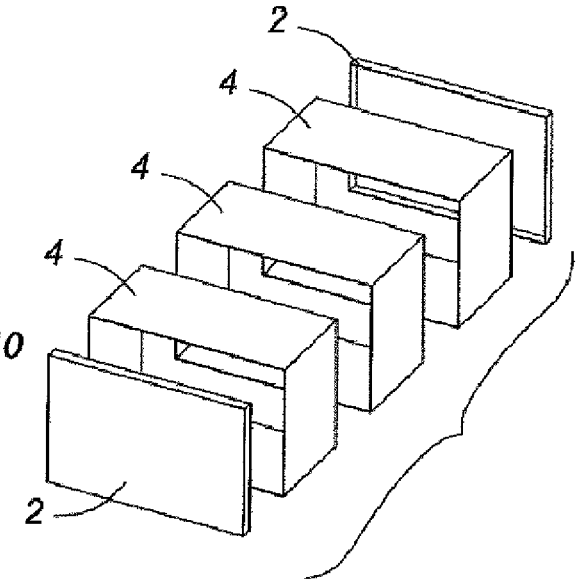
FIG. 2B PRIOR ART
Figure 3:
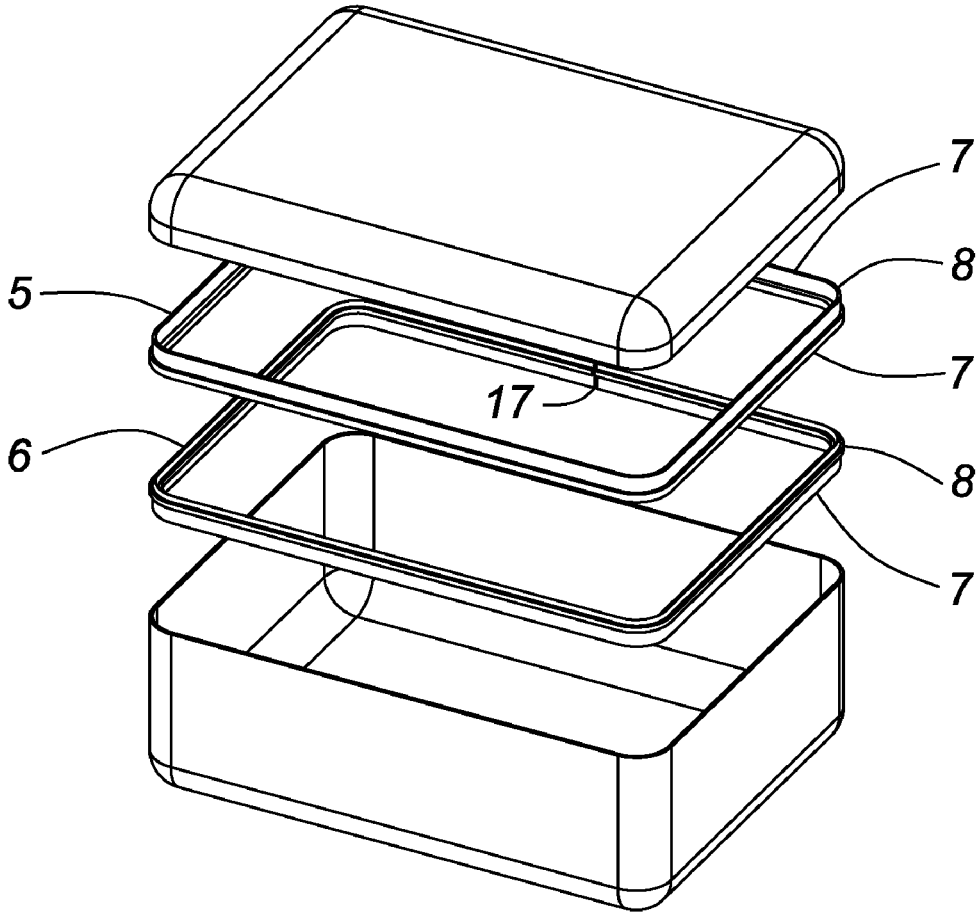
PRIOR ART FIG. 3
FIG. 3 is an exploded pictorial view of a prior art container having two valance frame subassemblies for the lid and box wherein the subassemblies are made from a single, integral piece bent into the form of a rectangle.

FIGS. 1 to 3 depict various sealable containers known in the art. FIGS. 1A and 1B illustrate a container 1 with a lid 2 and an open-faced bottom portion 1A. The lid 2 and bottom portion 1A may either be connected through a hinge means 9, as in FIG. 1B, or they may remain disjointed, as in FIG. 1A. FIGS. 2 and 2A describe a variant of this embodiment, in which a container comprises multiple base segments 4 each having two opposing, open regions and two enclosing lids 2, as depicted in FIG. 2B. The multiple base segments 4 are positioned sequentially, with valance interfaces 10 between each two base segments 4, forming an elongated container 1 as depicted in FIG. 2A. Again, two lids 2 are aligned to enclose the open ends of the container 1. In every instance, the dimensions of the lid and base combinations are such that they sufficiently complement each other so as to enclose a volume within the container 1.

According to another prior art configuration, at the boundary between the container and lid, a first valance frame 5 and a second valance frame 6 are provided, as seen in FIG. 3. These valance frames 5, 6 encircle the closure interface between the lid and container. Similar valance frames could be present between multiple base segments 4 of a container as in FIG. 2A. The valance frames 5, 6, in all such cases, engage one another to enclose two adjacent container segments.

FIG. 3 depicts the container provided with bent valance frames 5, 6 each with a radius corner 8. The radius corners 8 of FIG. 3 are formed from a single, uninterrupted valance frame member 7, bent at each of its corners to form a substantially mechanically continuous valance frame 5, 6. A discontinuity may exist at gap 17 where the two ends of frame member 7 join.

In order to reduce misalignment and instability between case segments, interfitting ridge 12 and grooves 13 as shown in FIGS. 4A, 4B, 5A, and 5B are provided on the outwardly facing valance mating surfaces of the valance frames 5, 6. The cross sectional shape of the mating faces of the valance frames 5, 6 must complement each other so as to facilitate interconnection.

Figure 4A:
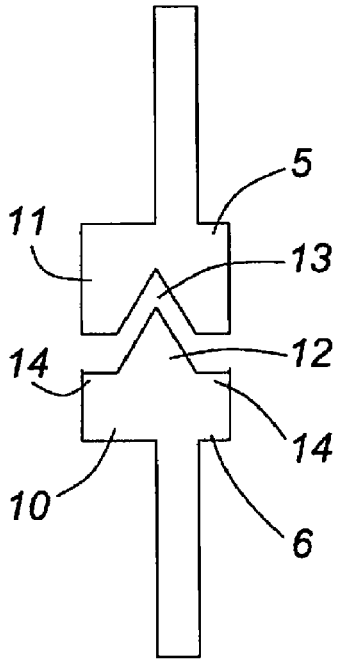
FIG. 4A PRIOR ART
FIGS. 4A and 4B are cross-sectional end views through a pair extruded longitudinal frame members of valance subassemblies respectively having single and double male ridges positioned for engagement with single and double grooves in the opposed subassembly.
Figure 4B:
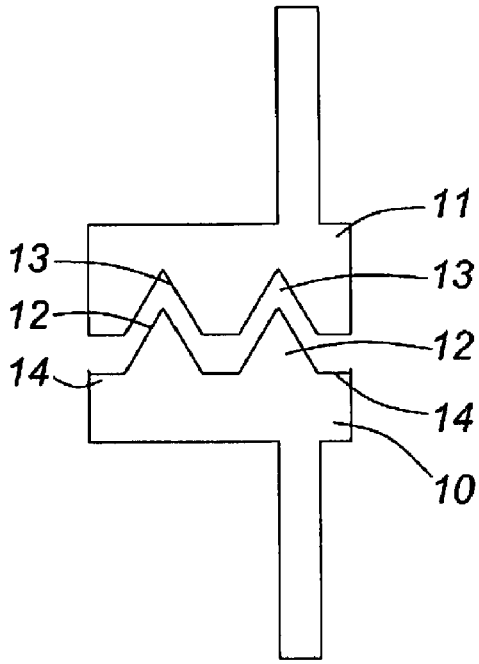
FIG. 4B PRIOR ART

FIGS. 4A and 4B depict cross-sectional views of two similar valance subassembly frame ridge 12 and groove 13 arrangements. In either instance, a male valance frame 10 and a female valance frame 11 are shaped to engage with one another. Their respective arrangements may include one ridge 12 or groove 13, as in FIG. 4A, or multiple ridges 12 or grooves 13, as in FIG. 4B.

Figure 5A:
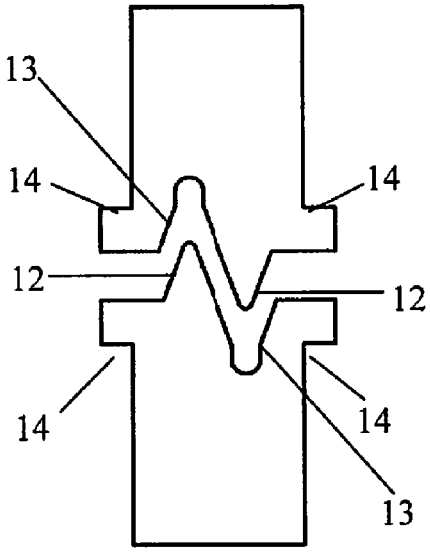
FIGS. 5A and 5B are cross-sectional end views through a pair extruded longitudinal frame members of valance subassemblies respectively having single and double hybrid male ridges and female grooves positioned for engagement with complementary grooves and ridges in the opposed subassembly.
Figure 5B:
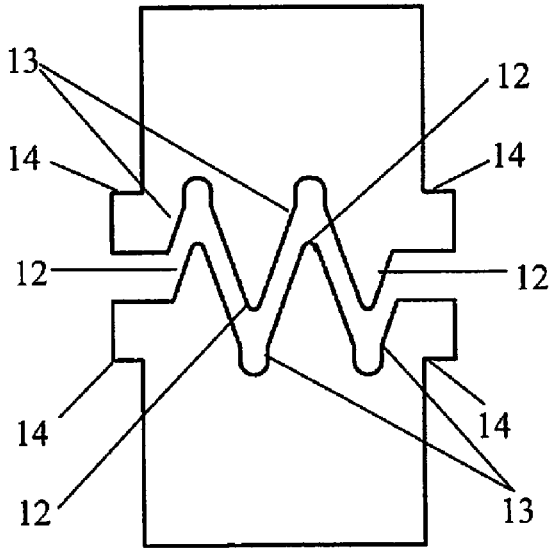

A hybrid variant is depicted in FIGS. 5A and 5B. Here, each valance subassembly is provided with both a ridge 12 and a groove 13. In FIG. 5B, each valance is provided with multiple ridges 12 and grooves 13.

Further to a valance's ridge 12 and groove 13 arrangement, the outwardly facing mating surfaces of each valance frame 10, 11 may be provided with a supplementary shoulder 14 which comes into contact with the leading edge of its respective container segment, e.g. a wall panel, thus allowing the valance frame 10, 11 to be stabilized in its relationship to the adjacent edge of the container wall panel. Typically this shoulder 14 is in the shape of a protruding rectangular shoulder; however, other configurations may be employed.

Figure 7A:
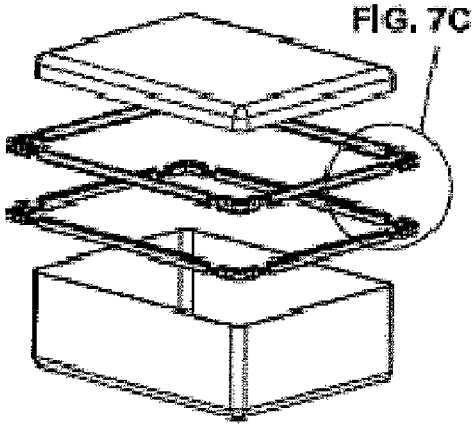
FIGS. 7A and 7B are exploded pictorial views of the container having two valance frame subassemblies respectively with rounded corner pieces in preassembled and fully assembled locations.
Figure 7B:
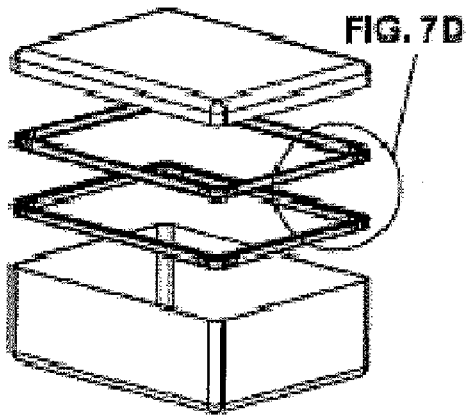
Figure 7C:
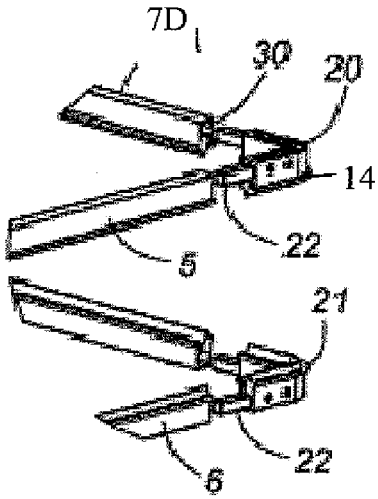
FIGS. 7C and 7D are exploded pictorial views of the container corners of FIGS. 7A and 7B respectively showing details of the rounded corner fittings.

Wall panel edges are positioned to terminate beneath the shoulder 14, overlying the side surfaces of the longitudinal frame members 7D and corner pieces 20, 21, as seen in FIG. 7C. Attachment or coupling means affixing such wall panels to the longitudinal frame members 7D. The corner pieces 20, 21 link these two latter components securely in place, holding them in a rigid relationship to each other. This helps maintain the alignment of the valance interface surfaces carried by these components.

Figure 6A:
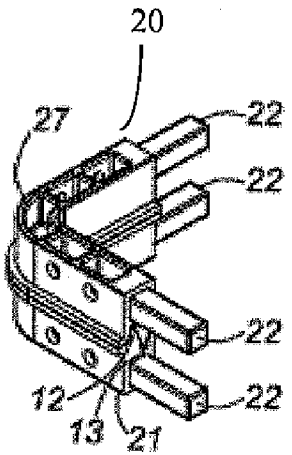
FIGS. 6A-G are three pictorial (6A-C) and side (6D), top (6E) and end (6F, G) views wherein views A, B, D, E and F depict the corner pieces in accordance with the invention, with rounded corners, assembled in contact with each other, and views 6C and 6G are exploded views before engagement between the corner pieces.

FIG. 6A depicts two complementary unitary corner pieces 20, 21 in accordance with the invention for use in a valance frame. The ends of each corner pieces 20, 21 are fitted with extending tongues 22. These tongues 22 are depicted in the form of rectangular prisms; however, various other shapes, such as cylinders, may be employed.

Figure 6B:
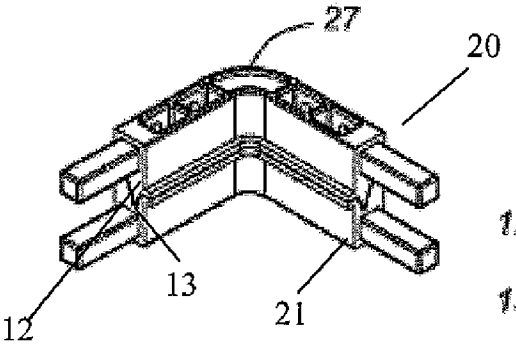

The corner pieces 20, 21, described in FIG. 7C, have a ridge 12, a groove 13 and supplementary shoulders 14 disposed thereon as described in FIG. 5A. The ridges 12 and grooves 13 are shaped complementary to one another to allow for engagement between the two corner pieces 20, 21, as shown in FIG. 6B. The ridge and groove arrangement may take the form of any of the configurations as discussed above and depicted in FIGS. 4A, 4B, 5A and 5B.

Figure 6C:
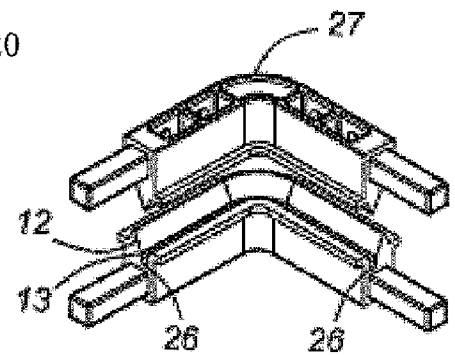
Figure 6D:
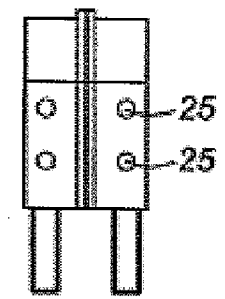
Figure 6E:
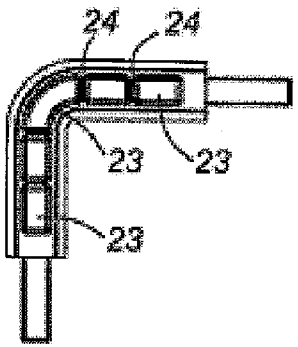

Underlying the valance carrying surfaces of the corner pieces 20, 21 are cavities 23 as shown in FIG. 6E. These cavities 23 are partitioned by bridging walls 24 positioned perpendicular to the length of the corner pieces 20, 21. As best seen in FIGS. 6A and 6D, the walls of cavities 23 are perforated by rivet holes 25 which may be used to connect the corner pieces 20, 21 to the walls of container segments such as lids 2 or base segments 4.

Figure 6F:
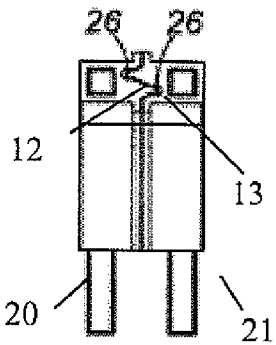
Figure 6G:
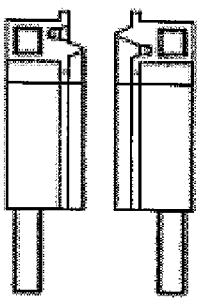

As seen in FIG. 6F, a gasket-accepting recess 26 is positioned along the vertices of each groove 13. When the corner pieces 20,21 are brought into engagement, the ridges 12 will forcibly contact a gasket, not shown, seated in the recess 26. This gasket, when contacted by a ridge 12, will help facilitate a fluid-impermeable boundary across the intersecting corner pieces 20,21.

Figure 8A:
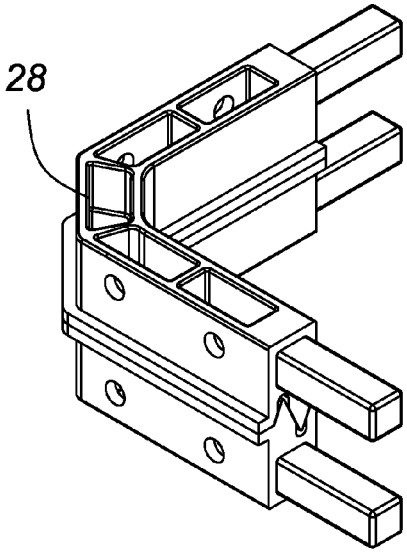
Figure 9A:
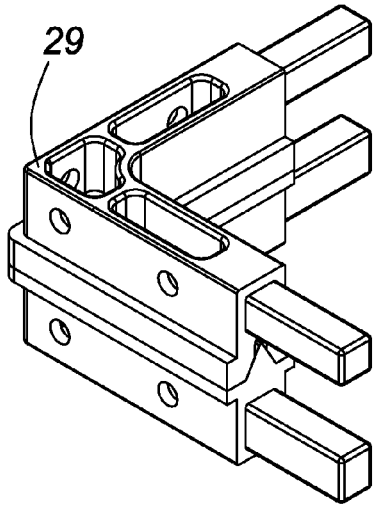
FIGS. 9A and 9B are respectively pictorial and side views of assembled corner pieces having a square corner.
Figure 8B:
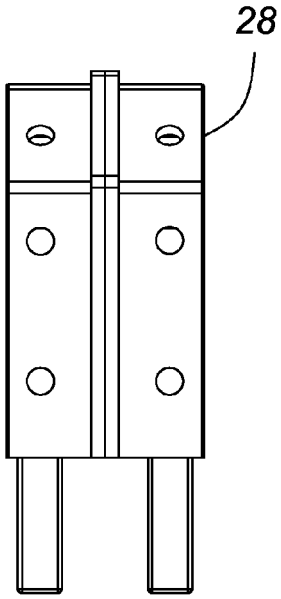
Figure 9B:
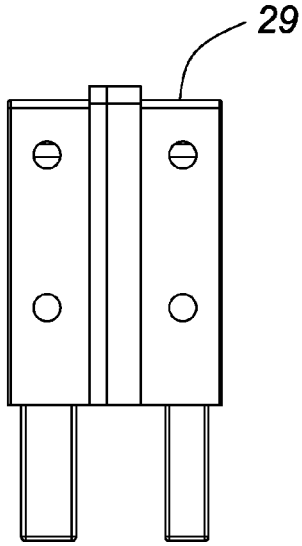

The bent region 27 of the corner pieces 20,21 depicted within FIGS. 6A, 6B, and 6C is shown in the form of a radius corner. The same corner piece configuration may be provided with a chamfered corner region 28, as seen in FIGS. 8A and 8B; as well as a sharp corner region 29 as seen in FIGS. 9A and 9B.

Figure 7D:
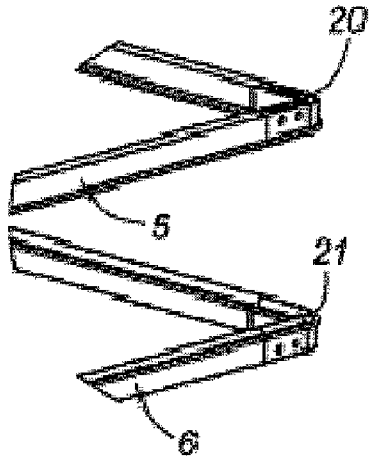

The corner pieces 20,21 may be incorporated into complementary valance frames 5,6, as shown in FIGS. 7A through 7D. Here, the extending tongues 22 penetrate the hollow cores 30 of the adjacent valance frame members 7 to provide a continuous valance there between. This is best depicted in FIGS. 7C and 7D.

Figure 10A:
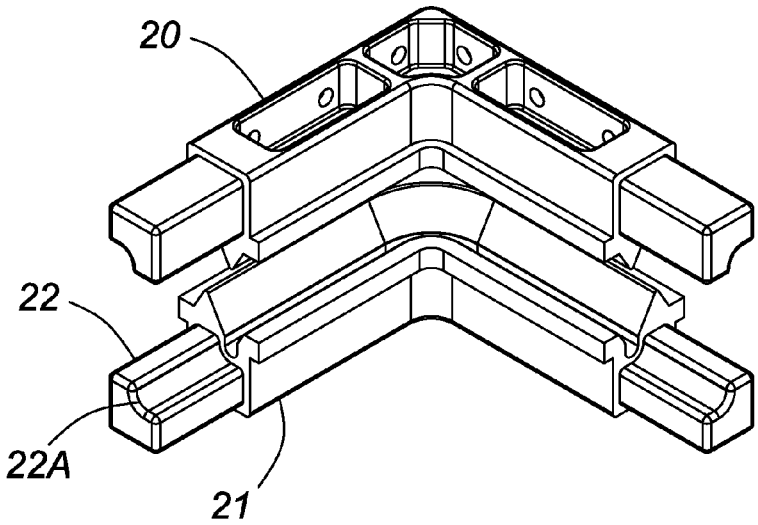
FIGS. 10A, 10B and 10C are respectively pictorial, top and side views of pairs of corner pieces having grooves formed in their tongues.
Figure 10B:
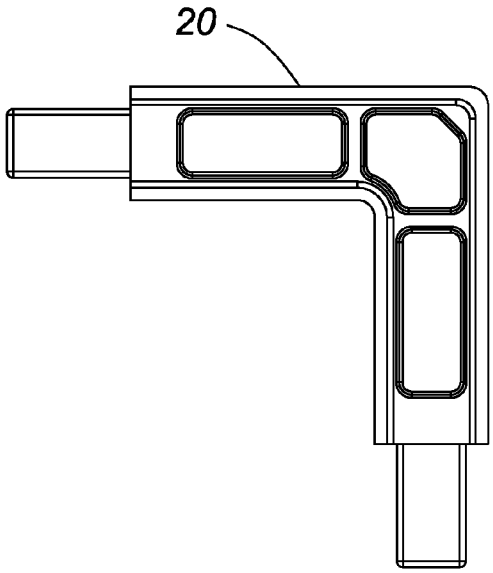
Figure 10C:
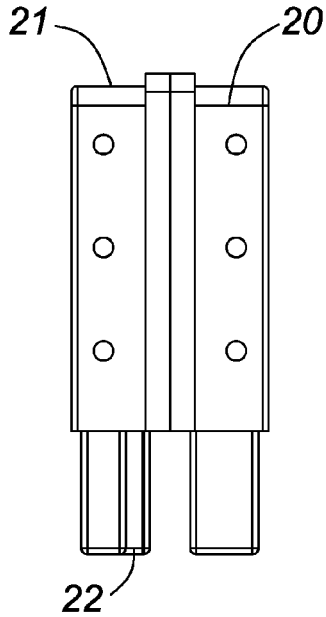
Figure 11A:
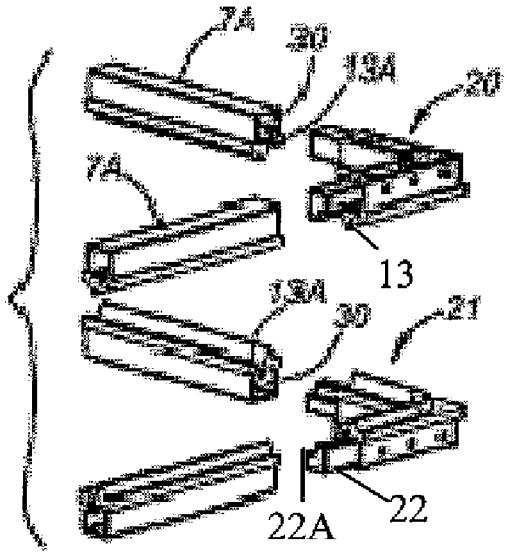
FIG. 11A is an exploded view of the corner pieces of FIG. 10A before being fitted into extruded longitudinal frame members.
Figure 11B:
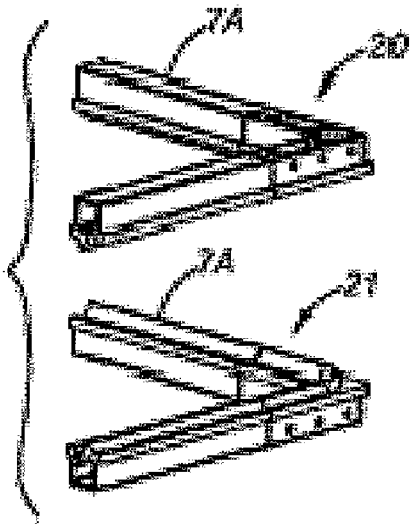
FIG. 11B is an exploded view of the corner pieces of FIG. 11A fitted into extruded longitudinal frame members but prior to engagement of such parts with each other.
Figure 11C:
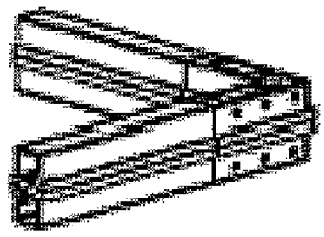
FIG. 11C is a view of the corner pieces of FIG. 11B fitted into extruded longitudinal frame members engaged with each other.

In FIGS. 10A, 10B and 10C, the corner pieces 20, 21 are depicted as having grooves 22A formed in their tongues 22. Extruded longitudinal frame members 7A shown in FIG. 11A are provided with a frame member groove 13A position to be aligned with the groove 13 formed in the corner piece. The extending tongues 22 of the corner piece are shaped with a cross-sectional shape other than in the form of a rectangle in order to fit into the end recess 30 formed by the core of the extruded frame members 7A. That recess is not rectangular in cross-section because the frame member groove 13A is supported by metal that intrudes into the core 30 of the extruded frame members 7A. The tongues 22 each have a tongue groove 22A formed along the length of the tongue to inter-fit into the shaped recess 30 in the frame members 7A as shown in FIG. 11A.

Conclusion

The foregoing has constituted a description of specific embodiments showing how the invention may be applied and put into use. These embodiments are only exemplary. The invention in its broadest, and more specific aspects, is further described and defined in the claims which now follow.

These claims, and the language used therein, are to be understood in terms of the variants of the invention which have been described. They are not to be restricted to such variants, but are to be read as covering the full scope of the invention as is implicit within the invention and the disclosure that has been provided herein.

I claim:

1. A valance frame assembly mating two objects, comprising a first and second planar valance frame subassembly, with each planar valance frame subassembly comprising:

a) a plurality of longitudinal frame members, each longitudinal frame member comprising:
   i. a recess at each end thereof; and
   ii. a frame member mating valance interface surface along an edge thereof; and b) a plurality of corner pieces, each corner piece comprising:
   i. an extending tongue at each end of the corner piece, the extending tongue being shaped to engage with the recess of one of the longitudinal member; and
   ii. a corner piece mating valance interface surface along an edge thereof;
      each longitudinal frame member being joined at its respective ends to a respective corner piece;
      the corner piece mating valance interface surface of each corner piece being aligned with the frame member mating valence interface surface of each joined longitudinal frame member to form a subassembly mating valence surface;
      each subassembly mating valence surface comprising an inner shoulder coplanar with an outer shoulder, such that when the first and second planar valance frame subassemblies mate, abutment of the shoulders defines a mating plane, wherein:

the subassembly mating valence surface of the first valance frame subassembly comprises:
   i. one or more ridges that extend below the mating plane; and
   ii. one or more grooves that extend above the mating plane, each groove having a continuous gasket recess at a base therein for receiving a gasket;

the subassembly mating valence surface of the second valance frame subassembly comprises:
   i. one or more ridges that extend above the mating plane; and
   ii. one or more grooves that extend below the mating plane, each groove having a continuous gasket recess at a base therein; and wherein the first and second valance frame subassemblies are mated such that:
   i. the longitudinal members of the first planar valance frame subassembly are positioned above the longitudinal members of the second planar valance frame subassembly;
   ii. the corner pieces of the first planar valance frame subassembly are positioned above the corner pieces of the second planar valance frame subassembly;
   iii. each ridge and groove on the first valence frame subassembly are positioned opposite a complementary groove and ridge of the second valence frame subassembly, thereby forming one or more mating pairs of a mating ridge and a mating groove;
   iv. for each mating pair, a surface of the mating ridge snugly engages with a surface of the mating groove; and
   v. for each mating pair, the gasket recess comprises a gasket fitted at the base of the mating groove, with the gasket engaging the mating ridge, thereby providing a seal therebetween.

2. The valance frame assembly of claim 1, wherein each corner piece is formed with one or more cavities underlying the corner piece mating valence interface surface, each cavity being defined by one or more bridging walls positioned perpendicular to a length of the corner piece.

3. The valence frame assembly of claim 2, wherein each cavity is provided with one or more fastener openings penetrating an outside wall of the corner piece.

4. The valence frame assembly of claim 1, wherein:

a. the frame member valance interface surface comprises a groove that intrudes into the recess thereby providing an internal longitudinal protrusion; and
b. the extending tongue of each corner piece has a cross-sectional shape that is provided with a tongue groove formed along a length of the extending tongue, so as to engage with the internal longitudinal protrusion within the longitudinal frame member.

5. The valance frame assembly of claim 4, wherein each corner piece is formed with one or more cavities underlying the corner piece mating valence interface surface, each cavity being defined by one or more bridging walls positioned perpendicular to a length of the corner piece.

6. The valence frame assembly of claim 5, wherein each cavity is provided with one or more fastener openings penetrating an outside wall of the corner piece.

7. The valence frame assembly of claim 4, wherein each corner piece has an identical corner region, the corner region being a chamfered corner, a sharp corner or a radius corner.

8. The valance frame assembly of claim 1, wherein:

a. one object is a lid and the second object is a body;
b. the lid and body together form a container; and
c. the first planar valance frame subassembly is carried on an inner surface of the lid and the second planar valance frame subassembly is carried on an inner surface of the body.

9. The valance frame assembly of claim 8, wherein each corner piece is formed with two or more cavities underlying the corner piece mating valence interface surface, each cavity being defined by one or more bridging walls positioned perpendicular to a length of the corner pieces.

10. The valence frame assembly of claim 9, wherein each cavity is provided with one or more fastener openings penetrating an outside wall of the corner piece for attachment of sidewalls of the container to the corner piece.

11. The valence frame assembly of claim 10, wherein the sidewalls are attached to each corner piece by means of fasteners extending through said fastener openings.

12. The valence frame assembly of claim 8, wherein each corner piece an identical corner region, the corner region being a chamfered corner, a sharp corner or a radius corner.

13. The valence frame assembly of claim 1, wherein each subassembly mating valence surface has one ridge and one groove.

14. The valence frame assembly of claim 1, wherein each subassembly mating valence surface has two ridges and two grooves.

15. The valence frame assembly of claim 1, wherein each corner piece has an identical corner region, the corner region being a chamfered corner, a sharp corner or a radius corner.

16. The valance frame assembly of claim 15, wherein each corner piece is formed with one or more cavities underlying the, corner piece mating valence interface surface, each cavity being defined by one or more bridging walls positioned perpendicular to a length of the corner pieces.

17. The valence frame assembly of claim 16, wherein each cavity is provided with one or more fastener openings penetrating an outside wall of the corner piece.

* * * * *